US007108731B2

(12) United States Patent
Park et al.

(10) Patent No.: US 7,108,731 B2
(45) Date of Patent: Sep. 19, 2006

(54) AIR CLEANING ROBOT AND SYSTEM THEREOF

(75) Inventors: Jee-su Park, Osan (KR); Seo-young You, Gwangju (KR); Ju-sang Lee, Gwangju (KR); Jang-youn Ko, Gwangju (KR); Jeong-gon Song, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 38 days.

(21) Appl. No.: 10/822,653

(22) Filed: Apr. 13, 2004

(65) Prior Publication Data

US 2005/0022485 A1 Feb. 3, 2005

(30) Foreign Application Priority Data

Jul. 29, 2003 (KR) ..... 10-2003-0052438

(51) Int. Cl.
*B01D 50/00* (2006.01)

(52) U.S. Cl. ..... 55/356; 55/385.1; 55/400

(58) Field of Classification Search ..... 55/318, 55/356, 385.1, 400, DIG. 3; 15/319, 340.1, 15/347

See application file for complete search history.

(56) References Cited

U.S. PATENT DOCUMENTS

| | | | | |
|---|---|---|---|---|
| 4,900,344 | A * | 2/1990 | Lansing | 55/322 |
| 5,534,762 | A * | 7/1996 | Kim | 318/568.12 |
| 5,839,156 | A | 11/1998 | Park et al. | |
| 5,925,172 | A * | 7/1999 | Rick et al. | 96/397 |
| 5,997,619 | A * | 12/1999 | Knuth et al. | 96/224 |
| 6,099,607 | A * | 8/2000 | Haslebacher | 55/356 |
| 6,459,955 | B1 | 10/2002 | Bartsch et al. | |
| 6,553,612 | B1 | 4/2003 | Dyson | |
| 2002/0153184 | A1 | 10/2002 | Song et al. | |
| 2002/0174506 | A1 * | 11/2002 | Wallach et al. | 15/319 |
| 2003/0028993 | A1 | 2/2003 | Song | |
| 2003/0150328 | A1 * | 8/2003 | Hansson et al. | 95/273 |

FOREIGN PATENT DOCUMENTS

| | | |
|---|---|---|
| CN | 1401289 A | 3/2003 |
| FR | 2590463 | 5/1987 |
| GB | 2344745 A | 6/2000 |
| GB | 2380563 A | 4/2003 |
| GB | 2382251 A | 5/2003 |
| JP | 226688 | 1/1990 |

(Continued)

OTHER PUBLICATIONS

Search Report (issued Sep. 22, 2004) issued from the Dutch Industrial Property Office for Dutch Patent Application No. 1026024, filed Apr. 23, 2004.

(Continued)

*Primary Examiner*—Frank M. Lawrence
(74) *Attorney, Agent, or Firm*—Blank Rome LLP

(57) ABSTRACT

An air cleaning robot and a system thereof which are capable of performing air cleaning while traveling around a predetermined area. The air cleaning robot includes a robot body, a driving part for driving a plurality of wheels disposed at lower portions of the robot body, an air cleaning part disposed in the robot body, for drawing-in dust-ladened air from a cleaning area, air filtering, and discharging cleaned air. A controller is disposed in the robot body for controlling the air cleaning part and the driving part. Accordingly, since the air cleaning robot and the system thereof perform air cleaning while traveling automatically around a predetermined area, there is an improvement in a residential household, living environment, and less of an inconvenience to operate.

15 Claims, 5 Drawing Sheets

FOREIGN PATENT DOCUMENTS

| | | |
|---|---|---|
| JP | 5343496 | 12/1993 |
| JP | 819596 | 1/1996 |
| JP | 10-075918 A | 3/1998 |
| KR | 1994-0000712 | 1/1994 |
| KR | 2003-0013008 | 2/2003 |

OTHER PUBLICATIONS

Combined Search and Examination Report (issued Aug. 20, 2004) issued from the British Patent Office for British Patent Application No. 0409428.5, filed Apr. 28, 2004.

Official Action issued by the Russian Patent Office in connection with corresponding Russian Application No. 2004116816.

Swedish Patent Office, Office Action issued Mar. 9, 2005 in connection with the corresponding application No. 0401646-5.

Korean Intellectual Property Office, Office Action dated Apr. 30, 2005, issued in connection with corresponding application No. 2003-52438.

Chinese Patent Office, Office Action issued Dec. 16, 2005 with respect to Chinese Patent Application No. 200410043117.4 filed on May 11, 2004.

French Patent Office, Preliminary Search Report issued May 12, 2005 with respect to French Patent Application No. 0407639 filed on Jul. 8, 2004.

US 5,338,324, 08/1994, Chiu et al. (withdrawn)

* cited by examiner

AIR CLEANING ROBOT AND SYSTEM THEREOF

REFERENCE TO RELATED APPLICATIONS

This application claims priority to copending Korean Patent Application No. 2003-52438 filed on Jun. 29, 2003, in the Korean Intellectual Property Office.

CROSS-REFERENCE TO RELATED APPLICATIONS

This application is related to copending Korean Patent Application Nos. 10-2003-00074216, filed Feb. 6, 2003; 10-2003-0013961, filed Mar. 6, 2003; 10-2003-0029242, filed Mar. 9, 2003; and 10-2003-51139, filed Jul. 24, 2003.

FIELD OF THE INVENTION

The present invention relates to an air cleaning robot and a system thereof, and more particularly, to an air cleaning robot and a system thereof which cleans ambient air while traveling around a predetermined area.

BACKGROUND OF THE INVENTION

Generally, a robot cleaner can determine a distance to an obstacle such as furniture, office appliances, or a wall in a predetermined area, by using a distance sensor, and avoids a collision with the obstacle while it performs an assigned task.

The cleaner robot includes a robot body, a driving part for driving the robot body, a controller for controlling the driving part, a memory device, and a transmitting and receiving part for inputting and outputting a command.

The assigned task includes work vacuuming a floor, and that task is usually performed upon receipt of a command from an operator. Although there are many robot cleaners available, there has been almost no air cleaning robot that performs air cleaning.

Due to the recent alarms prompted by the Asian Dust and the Severe Acute Respiratory Syndrome (SARS), people have become more concerned about the health and cleaner and fresh air.

Thus, a heretofore unaddressed need exists in the industry for a robot with an air cleaning function, to address the aforementioned deficiencies and inadequacies.

SUMMARY OF THE INVENTION

The present invention has been developed in order to solve the above shortcomings in the related art. Accordingly, an aspect of the present invention provides an air cleaning robot and a system thereof, which is capable of performing an air cleaning while traveling around a predetermined area.

The above aspect is achieved by providing an air cleaning robot, which performs air cleaning while traveling around a predetermined area. The air cleaning robot comprises a robot body, a driving part for driving a plurality of wheels disposed at lower portions of the robot body, and an air cleaning part disposed in the robot body for drawing-in dust-ladened air from a cleaning area, filtering the air, and discharging cleaned air. A controller is disposed in the robot body for controlling the air cleaning part and the driving part. The controller controls the driving part and the air cleaning part simultaneously so the robot travels around the predetermined area and, simultaneously performs air cleaning. The driving part may include a pair of driving motors disposed in the robot body which are driven by supplied power, a pair of driving wheels rotated by the pair of driving motors, a pair of driven wheels proceeding the pair of driving wheels, and a power transmitting means connecting the driving wheels and the driven wheels.

In one embodiment, the power transmitting means includes a timing belt, and the robot body is connected with a body cover to form an exterior of the air cleaning robot. The air cleaning part includes a suction driving source drawing-in dust-ladened air from the predetermined area, a suction port connected to one side of the body cover, and a discharge port connected to another side of the body cover to discharge the cleaned air, an air cleaning duct disposed in the robot body and in communication with the suction port and further to the discharge port. A plurality of filters are disposed in the air cleaning duct for filtering the drawn-in air. The suction port may be disposed at one side of a front portion of the body cover, and also may be disposed on one side of an upper portion of the body cover. The discharge port may also be disposed at the other side of the front portion of the body cover, and may be disposed at the other side of the upper portion of the body cover. In another embodiment, the suction driving source is disposed inside the air cleaning duct to draw-in air. The plurality of filters comprise a first filter for filtering out relatively large dust particles from drawn-in air, and a second filter for removing the minute dust particles and unpleasant odors.

The above aspect is also achieved by providing an air cleaning robot system, which includes a driving part for driving a plurality of wheels and a controller for controlling the driving part. The air cleaning robot system further comprises an air cleaning part controlled by a controller with the system traveling automatically along a predetermined area while simultaneously air cleaning. The air cleaning part may include a suction driving source for drawing-in dust-ladened air from the predetermined area, a suction port through which air is drawn-in, and a discharge port for discharging cleaned air. The air cleaning may further include at least one filter for filtering drawn-in air. When the suction driving source is driven by the controller, air is drawn-in through the suction port and filtered by the filter. Cleaned air is discharged through the discharge port.

DETAILED DESCRIPTION OF THE PREFERRED EMBODIMENT

Figure 1:
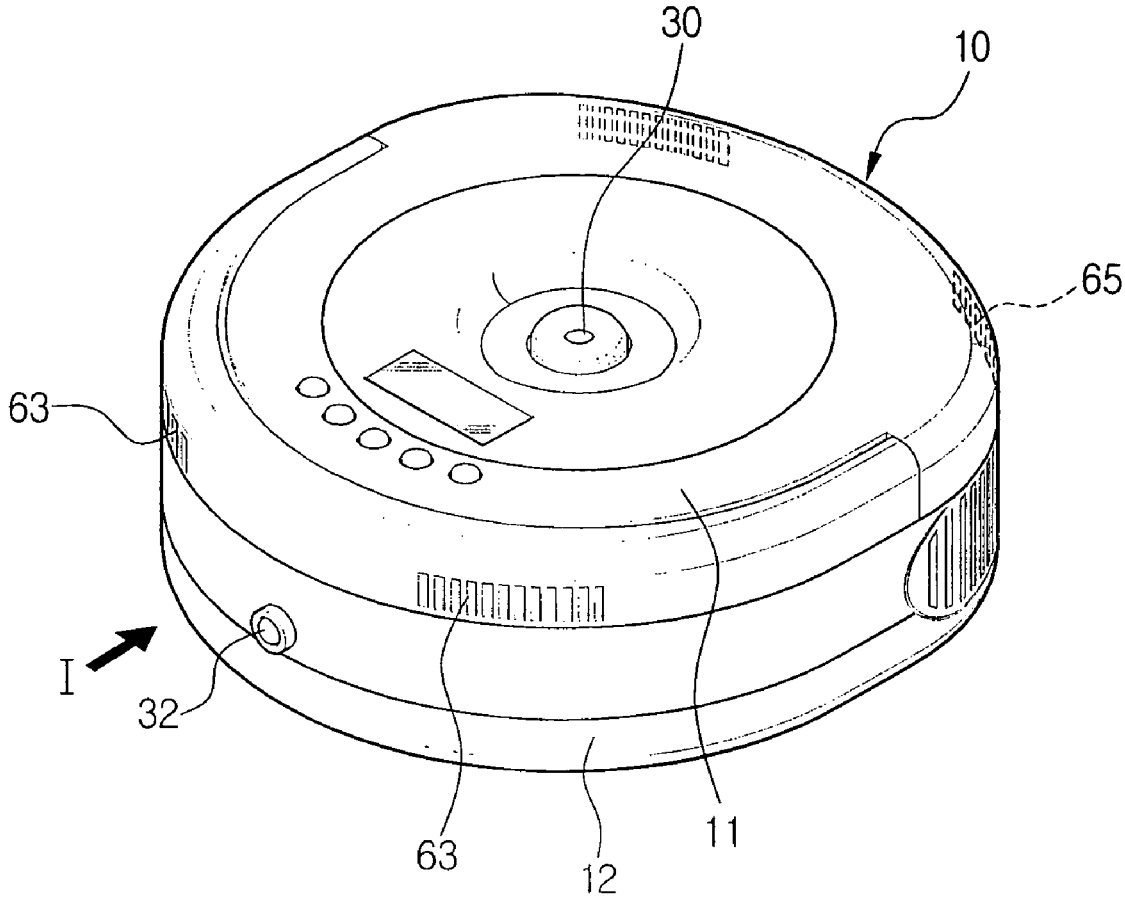
FIG. 1 is a drawing showing a perspective view of an air cleaning robot with an air cleaning part according to one embodiment of the present invention.
Figure 2:
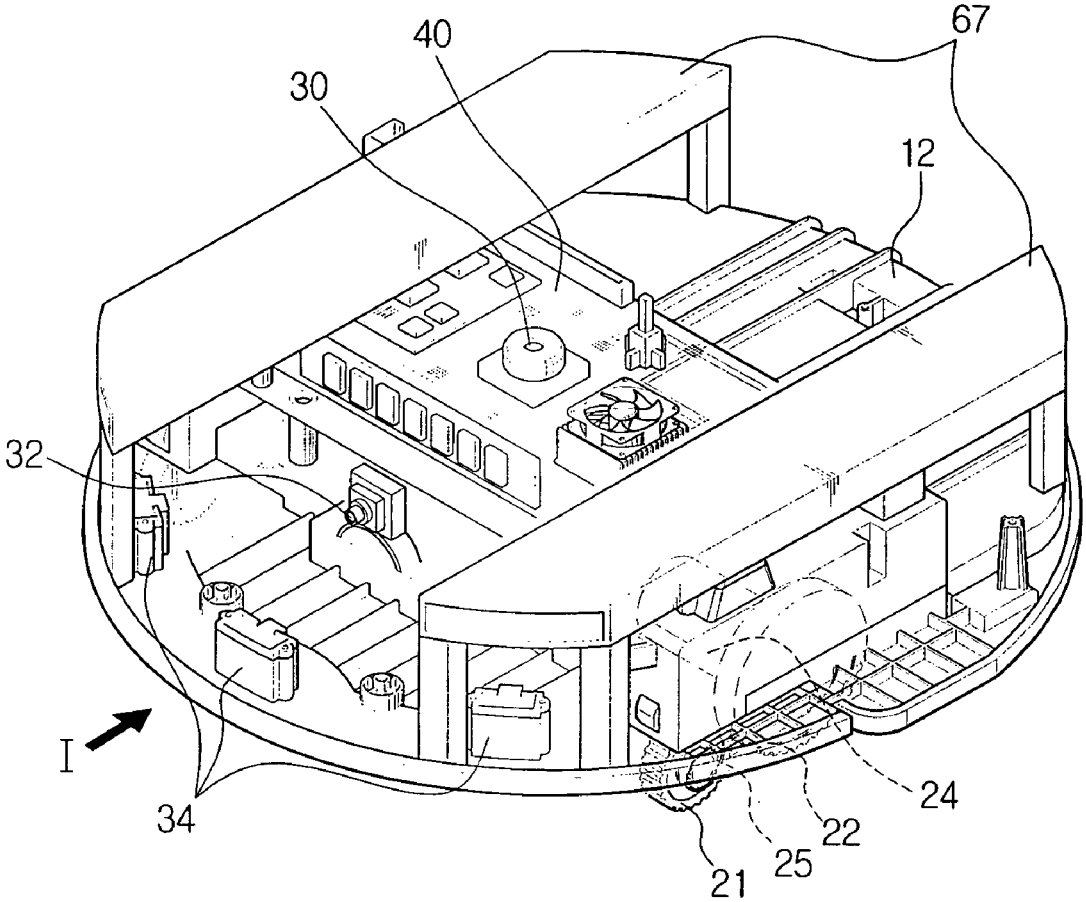
FIG. 2 is a drawing showing a perspective view of the air cleaning robot of FIG. 1 in which an upper cover is removed.

Referring to FIGS. 1–4, an air cleaning robot and a system according to one embodiment of the present invention are described in detail hereinbelow, in which reference sign 'I' indicates a forwarding direction of the robot. Referring to FIGS. 1–4, the air cleaning robot mainly includes a body 10, a body cover 11 connected to the body 12 to form the exterior of the air cleaning robot, a driving part 20, an upper camera 30, a front camera 32, an obstacle sensor 34, an air cleaning part 60, a controller 40, a memory device 41, and a transmitting and receiving part 43.

The driving part 20 includes two driven wheels 21 disposed at both front sides of the robot body 11, two driving wheels 22 disposed at both rear sides of the robot body 11, a pair of motors 24 rotationally driving the two rear driving wheels 22, respectively, and a power transmitting means 25 for transmitting power from the rear driving wheels 22 to the front driven wheels 21. The power transmitting means 25 includes a timing belt (not shown) or a gear pulley (not shown). The driving part 20 rotates the pair of motors 24 independently in a clockwise direction or a counter-clockwise direction in accordance with a control signal from the controller 40. The traveling direction of the cleaning robot 10 is determined by rotating the motors 24 at respective RPMs.

The front camera 32 is disposed in the body 12 to photograph front images and output the photographed images to the controller 40. The upper camera 30 is disposed in the body 12 to photograph upward images and output the photographed images to the controller 40. In another embodiment, the upper camera 30 employs a fish eye lens (not shown). Since the construction of the fish eye lens is disclosed in the Korean Publication Nos. 1996-7005245, 1997-48669, and 1994-22112 and is being marketed by various fish eye lens manufactures, a detailed description thereof is omitted.

The obstacle sensors 34 are arranged along a circumference of the body 12 at a predetermined interval to transmit signals to the outside and receive a reflected signal. Also, the obstacle sensor 34 may use an ultrasonic sensor emitting an ultrasonic wave and receive a reflected ultrasonic wave. The obstacle sensor 34 is used to measure a distance to an obstacle or a wall. The traveling distance sensor (not shown) connected to the controller 40 may use a rotation detecting sensor (not shown) for detecting RPMs of the driving wheels 22 and the driven wheels 21. In particular, the rotation detecting sensor may employ an encoder to detect RPMs of the motors 24.

Figure 3:
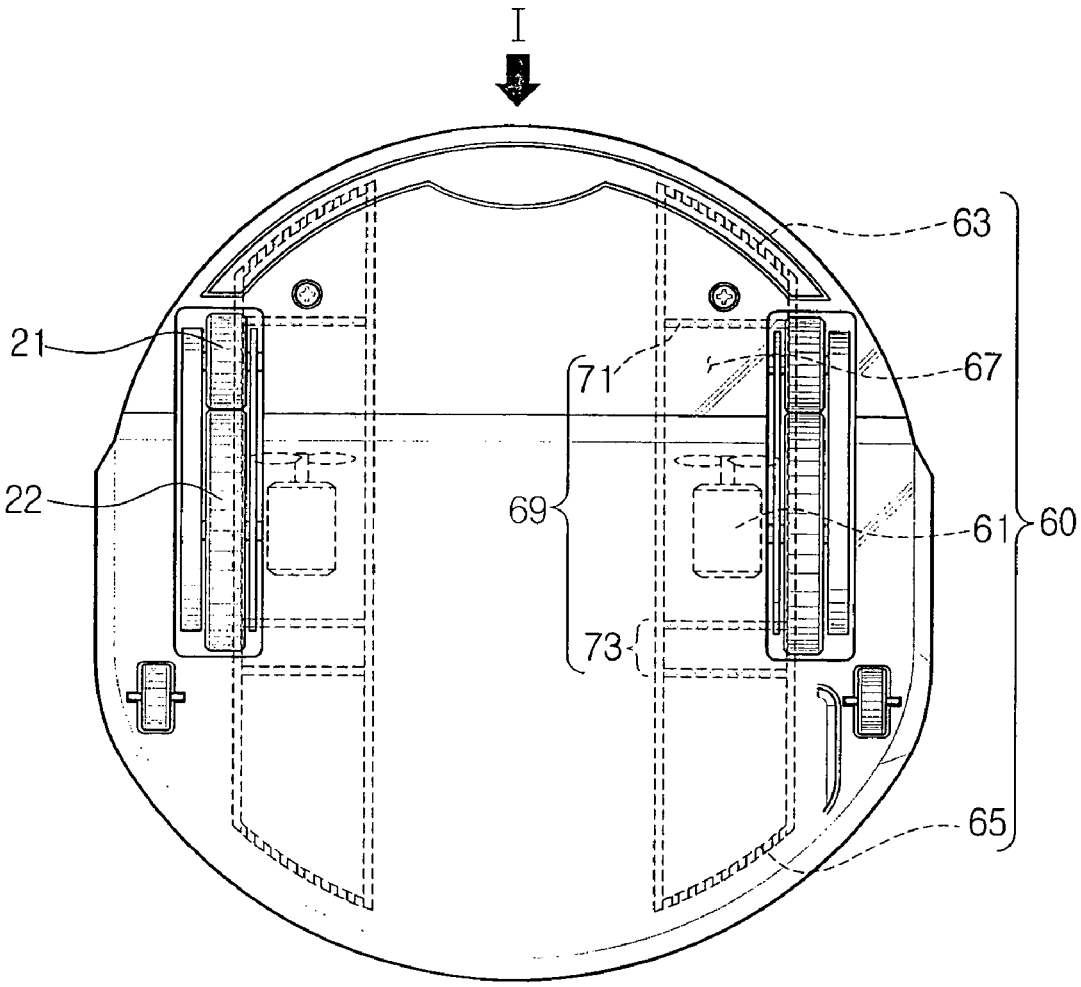
FIG. 3 is a plan view drawing showing the air cleaning part of the air cleaning robot of FIG. 1.
Figure 4:
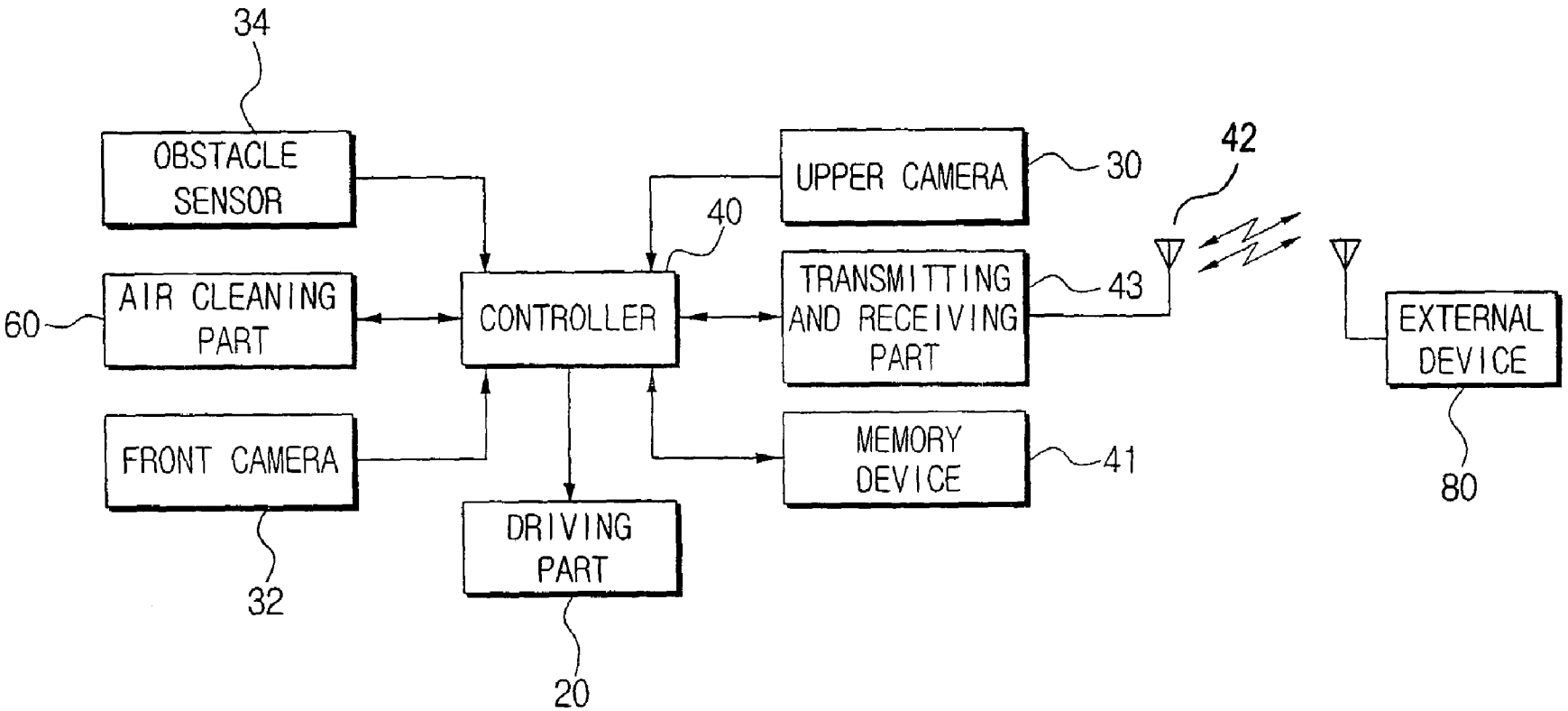
FIG. 4 is a block diagram showing a central control device of an air cleaning robot system according to one embodiment.

The air cleaning part 60 is disposed at an inner side of the body 12 to draw-in air from a cleaning area and filter out dust (FIG. 3). The air cleaning part 60 includes a suction driving source 61, a suction port 63 connected to one side of the body cover 11, a discharge port 65 connected to the other side of the body cover 11, an air cleaning duct 67, and a plurality of filters 69. The suction driving source 61 generates a suction force enabling dust-ladened air to be drawn-in from the cleaning area. The suction driving source 61 is disposed inside the air cleaning duct 67 to draw air in and also provide the suction force to the air cleaning part 60 in relation to movement of a driving motor (not shown), thus providing a driving force to the driving part 20 of the air cleaning robot. The suction driving source 61 can be embodied either in association with the driving motor (not shown) or separately if the suction driving source 61 provides the suction force to the air cleaning part 60. The suction driving source 61 may include a motor and a fan system.

Figure 5:
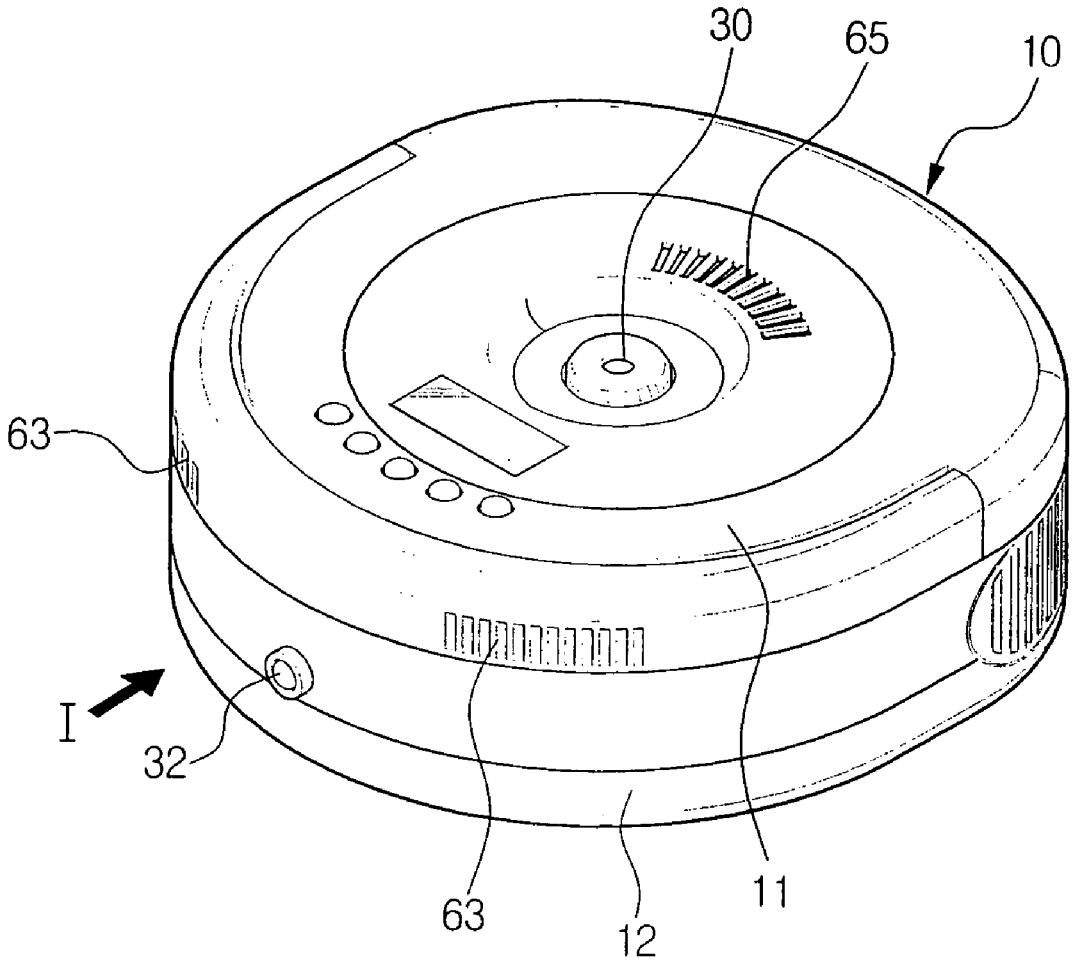
FIG. 5 is a drawing showing a perspective view of an air cleaning robot with an air cleaning part according to one embodiment of the present invention.

The suction port 63 is disposed in one front side or one upper side of the body cover 11, and the discharge port 65 is disposed in the other front side or the other upper side of the body cover 11. As shown in FIG. 1, the suction port 63 may be disposed in one front side of the body cover 11, while the discharge port 65 may be disposed in one rear side of the body cover 11. Thus, the positions where the suction port 63 and the discharge port 65 are disposed may be varied. For example, the suction port 63 may be disposed in one front side of the body cover 11, while the discharge port 65 may be disposed in one upper side of the body cover 11 as shown in FIG. 5. Also, there may be provided at least two suction ports 63 and at least two discharge ports 65. In that case, each suction port 63 and discharge port 65 may be disposed independently from the air cleaning duct 67, or may be connected to the air cleaning duct 67.

The air cleaning duct 67 is in fluid communication with the suction port 63 through the discharge port 65 so that air drawn-in through the suction port 63 by the suction driving source 61 is discharged through the discharge port 65 via the air cleaning duct 67. As long as the fluid communication with the suction port 63 through to the discharge port 65 is ensured, the communication line may take various forms such as a straight line or a curved line.

The plurality of filters 69 function to filter air drawn-in through the suction port 63. The filters 69 include a first filter 71 and a second filter 73. The first filter 71 filters out relatively larger dust particles from the air, while the second filter 73 filters out relatively minute dust particles and distasteful odors from the large dust-removed air. In another embodiment, the second filter 73 uses a commercially available hepa filter to filter bacteria, virus, molds, house dust and, minute bacteria from animals which can cause respiratory system disorder and allergies in humans. The second filter 73 may use a commercially available deodorizing filter for removing various smells.

The controller 40 processes signals received through the receiving and transmitting part 43 and controls those respective components. The air cleaning robot may further comprise a key input apparatus (not shown). In that case, the key input apparatus (not shown) is formed in the body 12 and has a plurality of keys for manipulating a function setting of the air cleaning robot 10, and the controller 40 processes a key signal inputted through the key input apparatus (not shown).

The controller 40 operates the driving part 20 and the air cleaning part 60, simultaneously, so that the air cleaning robot 10 performs air cleaning while traveling around a predetermined area. The memory device 41 stores the upward images photographed by the upper camera 30 and assists the controller 40 in calculating the location and traveling information.

The receiving and transmitting part 43 transmits data to an external device 80 via an antenna 42 and also transmits signals received from the external device 80 via the antenna to the controller 40. The external device 80 includes a wireless relay apparatus (not shown) and a remote controller (not shown) through which data is input and output. In this embodiment, the external device 80 is a remote controller.

The controller 40 controls the driving part 20 to drive the air cleaning robot to travel around a working area according to a traveling pattern, creates an image map with respect to an upward area from the upward image photographed by the upper camera 30, and stores the created image map in the memory device 41. Alternatively, when a working command is wirelessly received through the key input apparatus or from the outside, the image map can be created before a task is performed. After the creation of the image map, the controller 40 recognizes a location by using the created image map while working. That is, when a command signal for the job or task is inputted wirelessly through the key input apparatus or from the outside, the controller 40 recognizes a current location by comparing a current image inputted from the upper camera 30 or the front camera 32 with the memorized image map, and commands the driving part 20 to follow a traveling path from the current location to a target location. The work commanding signal includes a cleaning, or a monitoring by cameras 31, 32.

When the air cleaning robot 10 runs along the traveling path to the target location, the driving part 20 is directed to calculate a traveling error by using a traveling distance measured by the encoder and the current location recognized by the comparison of the currently photographed image and the memorized image map, and compensate the error, thereby tracking the traveling path to the target location. While the air cleaning robot is traveling, the controller 40 commands the air cleaning part 60 to operate according to the work commanding signal. As the suction driving source 61 is driven by the controller 40, air is drawn-in through the suction port 63 and filtered by the filters 69 from the air cleaning part 60, and cleaned air is discharged through the discharge port 65. Accordingly, the air cleaning robot 10 air cleans while traveling around the predetermined area.

When a user inputs a signal to stop the operation of the driving part 20 through the external device 80, the air cleaning robot 10 stops at a predetermined position, but continues air cleaning. When the user inputs a work stopping command through the external device as when air cleaning is completed, the controller 40 stops the air cleaning work and returns the air cleaning robot 10 to an initial position.

The foregoing embodiment and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An air cleaning robot, which performs air cleaning while traveling around a predetermined area having an atmosphere, comprising:

a robot body;

a driving part for driving a plurality of wheels disposed at lower portions of the robot body;

an air cleaning part disposed in the robot body, for drawing-in air from an open intake directed toward the atmosphere and located at a distance from any surface so as to draw air from the atmosphere rather than such surfaces, filtering the atmospheric air, and discharging cleaned air into the atmosphere; and a controller disposed in the robot body for controlling the air cleaning part and the driving part.

2. The air cleaning robot as claimed in claim 1, wherein the controller controls the driving part and the air cleaning part simultaneously which allows the robot to both travel around the predetermined area while simultaneously air cleaning.

3. The air cleaning robot as claimed in claim 1, wherein the driving part comprises:

a pair of driving motors disposed in the robot body and driven by power supplied respectively thereto;

a pair of driving wheels rotated by the pair of driving motors;

a pair of driven wheels proceeding the pair of driving wheels; and a power transmitting means connecting the driving wheels and the driven wheels.

4. The air cleaning robot as claimed in claim 3, wherein the power transmitting means includes a timing belt.

5. The air cleaning robot as claimed in claim 1, wherein the robot body is connected to a body cover and forms an exterior of the air cleaning robot, and the air cleaning part comprises:

a suction driving source drawing-in the air from the predetermined area;

an open suction port connected to one side of the body cover and oriented and connected to draw air from the atmosphere rather than a surface;

a discharge port connected to another side of the body cover to discharge cleaned air;

an air cleaning duct disposed in the robot body in communication with the suction port through to the discharge port; and a plurality of filters disposed in the air cleaning duct for filtering drawn-in air.

6. The air cleaning robot as claimed in claim 5, wherein the suction port is disposed at one side of a front portion of the body cover.

7. The air cleaning robot as claimed in claim 5, wherein the suction port is disposed on one side of an upper portion of the body cover.

8. The air cleaning robot as claimed in claim 6, wherein the discharge port is disposed at another other side of the front portion of the body cover.

9. The air cleaning robot as claimed in claim 7, wherein the discharge port is disposed at another side of a front portion of the body cover.

10. The air cleaning robot as claimed in claim 6, wherein the discharge port is disposed at another side of an upper portion of the body cover.

11. The air cleaning robot as claimed in claim 7, wherein the discharge port is disposed at another side of the upper portion of the body cover.

12. The air cleaning robot as claimed in claim 5, wherein the suction driving source is disposed inside the air cleaning duct to draw-in air.

13. The air cleaning robot as claimed in claim 5, wherein the plurality of filters comprises:

a first filter for filtering out relatively large dust particles from drawn-in air; and a second filter for removing minute dust particles and unpleasant odors.

14. An air cleaning robot system operating in an atmosphere, which comprises a driving part for driving a plurality of wheels on a surface and a controller for controlling the driving part, further comprising an air cleaning part controlled by a controller, the air cleaning part operating to draw in air through an open intake directed toward the atmosphere and located at a distance from the surface such that the intake does not draw dust from the surface, and further operating to filter air and return it to the atmosphere, the system automatically traveling along a predetermined area while simultaneously air cleaning.

15. The system as claimed in claim 14, wherein the air cleaning part comprises a suction driving source for drawing-in air from the predetermined area, a suction port through which air is drawn-in, a discharge port for discharging cleaned air therethrough, at least one filter for filtering drawn-in air, and, when the suction driving source is driven by the controller, air is drawn-in through the suction port and filtered by the filter, and cleaned air is discharged through the discharge port.

* * * * *